US006352447B1

(12) United States Patent
Ruth

(10) Patent No.: US 6,352,447 B1
(45) Date of Patent: Mar. 5, 2002

(54) CABLE BUNDLE CONNECTOR

(75) Inventor: Bill Ruth, Cumming, GA (US)

(73) Assignee: Techsonic Industries, Inc., Eufala, AL (US)

( * ) Notice: Subject to any disclaimer, the term of this patent is extended or adjusted under 35 U.S.C. 154(b) by 0 days.

(21) Appl. No.: 09/535,052

(22) Filed: Mar. 24, 2000

(51) Int. Cl.[7] ..... H01R 13/60
(52) U.S. Cl. ..... 439/540.1; 439/501
(58) Field of Search ..... 439/540.1, 501, 439/544, 686, 247

(56) References Cited

U.S. PATENT DOCUMENTS 4,780,090 A * 10/1988 Sugiyama et al. ..... 439/247
5,454,733 A * 10/1995 Watanae et al. ..... 439/540.1
5,967,808 A * 10/1999 Kubota ..... 439/157

OTHER PUBLICATIONS

Installation instructions, Humminbird Wide 3D Paramount, pp. 27–33, Techsonic Industries, Inc., Eufala, Alabama (undated).

Installation instructions, Humminbird Depth Finder, Techsonic Industries, Inc. Eufala, Alabama (undated).

* cited by examiner

*Primary Examiner*—Tho D. Ta
*Assistant Examiner*—James R. Harvey
(74) *Attorney, Agent, or Firm*—Baker, Donelson, Bearman & Caldwell

(57) ABSTRACT

A cable bundle connector for simultaneously attaching or detaching a plurality of cables having cable connectors and wires extending therefrom to operational devices, comprising a housing body with two pairs of opposing sides that defame an interior cavity for receiving a plurality of cables for being connected to an operational device. A cable receiver defines a plurality of sleeves, each configured for receiving a cable connector of one of the plurality of cables. One side defines a slot through which a portion of the cable passes into the connector. Fasteners secure the cable receiver to an open end of the housing. The cable connectors being received in the sleeves with the wires extending outwardly of the housing body are readily connected simultaneously to an operational device.

15 Claims, 2 Drawing Sheets

CABLE BUNDLE CONNECTOR

The present invention relates to apparatus for connecting cables to operational devices. More particularly, the present invention relates to connectors for attaching a bundle of cables to operational devices.

BACKGROUND OF THE INVENTION

Boating and water-related activities are becoming an increasingly important recreational as well as commercial activity. Recreational boaters have a wide variety of activities in which to participate. These activities include pleasure boating, water skiing, swimming, fishing, and other related activities. Commercial boating typically relates to the fishing industry. Pleasure boaters as well as commercial boaters have an increasing array of auxiliary equipment for use. This auxiliary equipment not only increases the enjoyment of the boating activity, but provides increased safety in boating as well. One such piece of auxiliary equipment is a depth finder. Depth finders use sound waves to locate and define underwater objects. Sound waves are sent into the water in a controlled beam from a transducer mounted on the boat. Objects within the beam reflect the sound waves back to the transducer. The depth finder measures the distance to the objects based on the time it takes for the sound wave to return. Each object, such as a bottom surface, fish between the boat and the bottom, or a structure in the water, reflects the sound wave differently. The reflected sound provides information about the makeup and type of the object. The depth finder displays the return signals as information about the bottom contours, suspended objects such as fish, and structures located in the water.

The depth finders typically have several cables which are detachably engaged to the depth finder. These cables include a transducer cable, a power cable, and a speed/temperature sensor cable. The cables typically have cable ends that house electrical connectors, such as pins or slots, which communicate with wires carrying electrical signals. The transducer cable connects to the transducer mounted on the transom of the boat. This cable communicates an electrical signal representative of the sound wave reflected by the below-surface object. The power cable communicates with a power supply on the boat. The speed/temperature cable connects to a sensor mounted on the transom for communicating the rate of travel of the boat through the water and the temperature of the water. These cables plug into mating receptacles in the back of the depth finder.

Owners of small open boats typically remove equipment from the boat after boating. This is to avoid pilferage from the boat while the owner is away. Often the housings for depth finders are equipped with quick release mechanisms for installing and removing the depth finders. However, in order to remove the depth finder from a boat, not only is the depth finder housing detached from the quick release mount, but the three cables must be separately detached as well. Upon resumption of boating activities, the cable ends of the three cables must be picked up and inserted into the depth finder separately. This is not only a problem due to the annoyance of locating the cable ends, but the cable ends loose in the boat may become damaged or corroded.

Accordingly, there is a need in the art for an improved apparatus for connecting cables to depth finders for use on boats. It is to such that the present invention is directed.

SUMMARY OF THE INVENTION

The present invention meets the need in the art by providing a cable connector for simultaneously engaging and disengaging with operating devices. The cable bundle connector comprises a housing body have two pairs of opposing sides that define an interior cavity with an open front end of the housing body and an opposing partially closed back end. One side of the housing body defines a slot from the open front end to the partially closed back end for receiving a plurality of cables. Each cable has a cable connector at a first distal end of elongate wires in the cable and an operational device at a second distal end thereof, with the cable connector and the operational device for at least one of the cables being too large to fit through the partially closed end of the housing body. A cable receiver defines a plurality of sleeves, each configured to receive a cable connector of one of the plurality of cables. Fasteners secure the cable receiver to the open front end of the housing. The housing body, receiving the wires of the cables through the slot, enables the cable connectors to be received in the respective sleeves with the wires passing outwardly of the housing body through the partially closed back end so that the cable connectors are readily connected or disconnected simultaneously to the electronic apparatus.

Objects, advantages, and features of the present invention will become apparent upon a reading of the following detailed description and claims in view of the appended drawings.

DETAILED DESCRIPTION OF THE PREFERRED EMBODIMENTS

Figure 1:
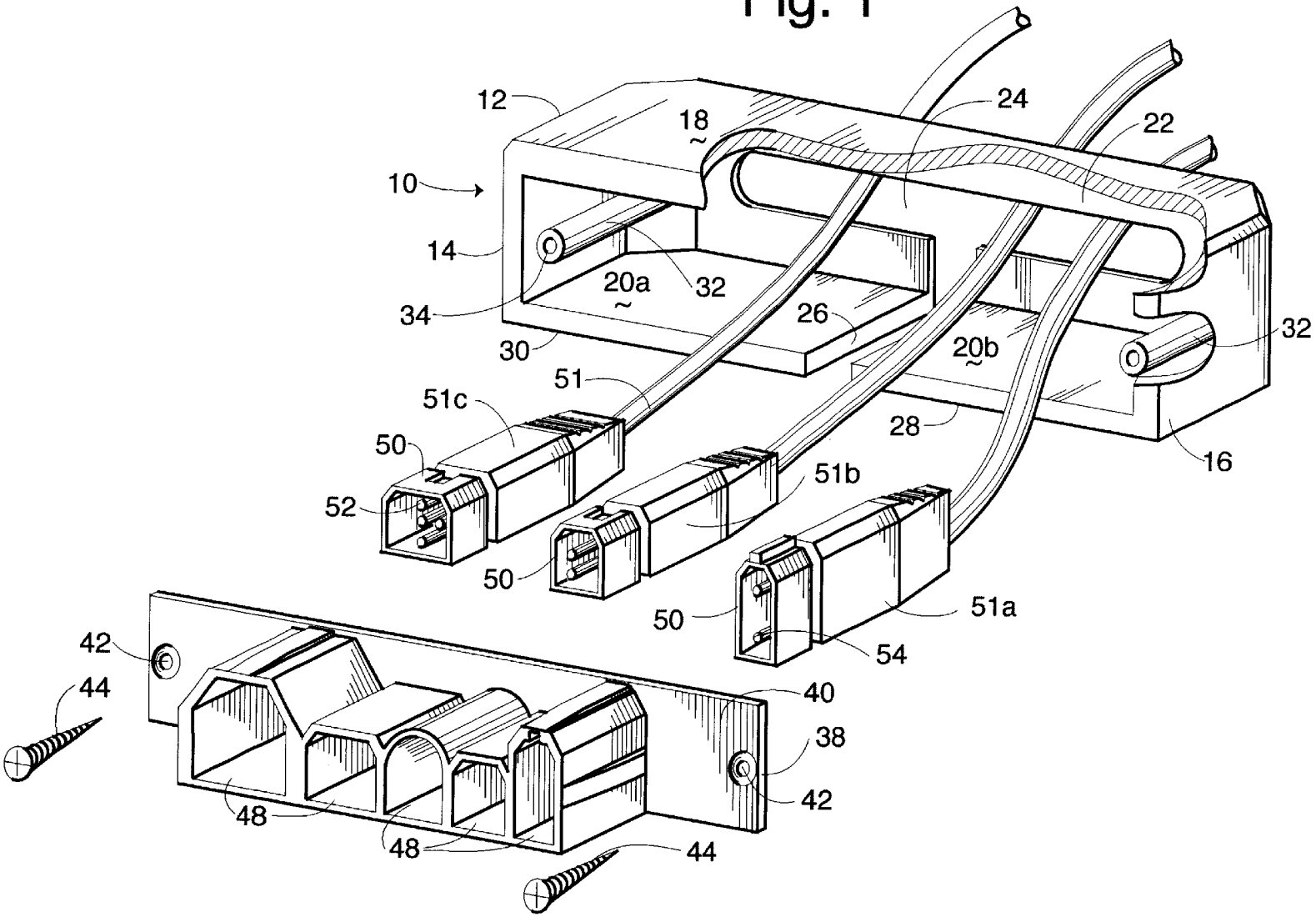
FIG. 1 is an exploded perspective view of the cable housing of the present invention.

Referring now in more detail to the drawings in which like parts have like identifiers, FIG. 1 is a perspective view of a cable connector 10 according to the present invention, illustrated in exploded view. The cable housing 10 includes a shell 12 defined by opposing sides 14, 16, opposing top and bottom surfaces 18, 20*a* , 20*b* and a back 22. The back 22 defines an opening 24 through which wires 25 of electrical cables extend. In the illustrated embodiment, the bottom walls 20*a* , 20*b* define a slot 26 extending from a front edge 28 to the back wall 22, for a purpose discussed below. The shell 12 defines an opening generally 30 opposing the back 22. The opposing sides 14, 16 each include projections 32. Each of the projections 32 define an open channel 34 extending along a longitudinal axis of the respective projection. In the illustrated embodiment, the leading edge of the projection 32 is recessed relative to a front edge of the housing 12.

The housing 12 engages a cable receiver 38. The cable receiver 38 is defined by a plate 40 sized for being received through the opening 30 of the housing 12 into a front portion of the housing. The plate 40 bears against the projections 32. The plate 40 defines a pair of openings 42 at the opposing distal ends. The openings 42 align with the channels 34 in the projections 32. A threaded fastener 44 extends through the respective opening 42 and into the channel 34 for securing the cable receiver 38 to the shell 12.

A plurality of open-ended sleeves 48 extend from a first side of the plate 40. In the illustrated embodiment, each sleeve 48 differs in cross-sectional shape, so that the sleeve conformingly receives an end 50 of a particular cable 51. The end 50 of the cable is a housing or connector that includes pins generally 52 or sockets generally 54 as appropriate, for mating engagement with connectors in an electronic apparatus, such as a depth finder 60 illustrated in FIG. 2, that receives the cables. An elongate length of cable 51 extends outwardly from the respective cable connector. Wires in the cable 51 communicate with the pins 52 and sockets 54. A distal end of the respective cable 51 connects to a respective operational device 57 such as a power supply or sensor shown schematically in FIG. 2 associated with the electronic apparatus using the cables. For example, for a depth finder, one of the cables 51*a* provides a connection to a source of electrical power. Another of the cables 51*b* connects to a transducer which is preferably mounted on the transom of a boat or bonded to the inside of the hull. The transducer converts electrical energy from the transmitter into mechanical pulses or sound waves, and also receives the reflected sound waves and converts it back into electrical signals for display by the depth finder. Another of the cables 51*c* for a depth finder communicates with the speed and temperature sensor. The sensor takes readings from the water at the surface and is preferably installed in contact with the water in an area having smooth water flow. The cable ends 50 and the operational devices 57 are too large to pass through the opening 24 in the back 22 of the connector 10. In the illustrated embodiment, the cable receiver 38 defines five sleeves 48 of which three are used, leaving two for future developments in the technology of the particular electronic apparatus.

Figure 2:
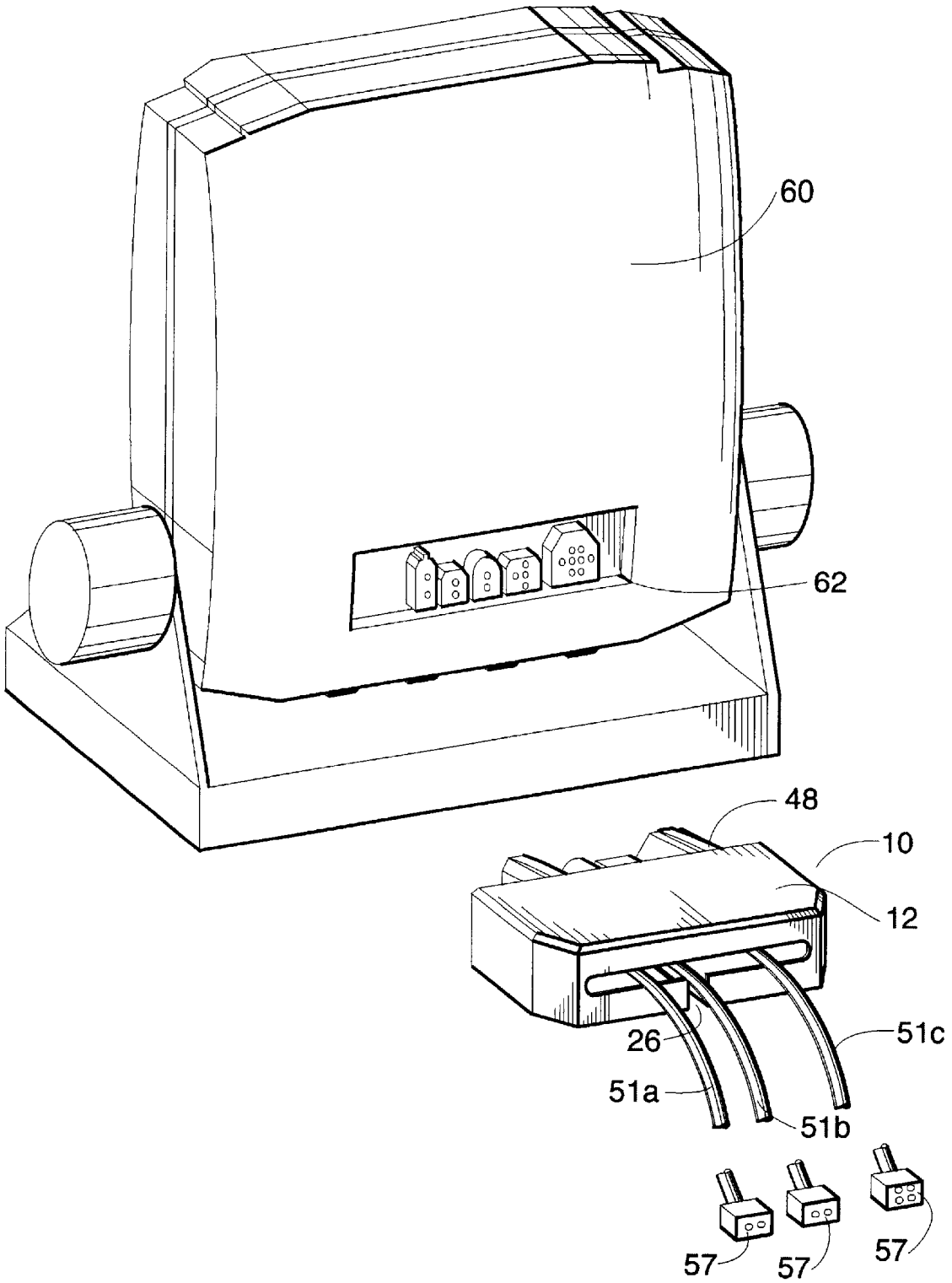
FIG. 2 is a perspective view of the cable housing shown in FIG. 1 for coupling to a depth finder.

FIG. 2 illustrates the assembled cable connector 10 separated from a back side of a depth finder 60. The back of the depth finder 60 includes a port 62 sized for conformingly receiving the channels 48. The port 62 includes connectors 64 which matingly engage the pins and sockets 52, 54 of the respective cables 50.

Returning to FIG. 1, the cable connector 10 is assembled by sliding the cables 51 through the slot 26 and the opening 24 in the back. The slot 26 facilitates receiving the cables 56 into the shell 12. The end 50 of the cable 51 is received in the particular conforming sleeve 48. One embodiment (not illustrated) includes grips for securing the cable ends 50 in place within the sleeve 48. In this embodiment, the sleeve includes a projecting tab to engage a detent on the cable end 50 for locking the cable 51 to the sleeve. It is to be appreciated that the shell 12 and the cable receiver 38 are manufactured by molding with a plastic material.

After the cables 50 are engaged to the respective sleeves 48 with portions of the cables 51 extending outwardly from the shell 12 through the opening 24, the cable receiver 38 is engaged to the shell 12. The plate 40 is received in the opening 30 and seated against the recessed projections 32. The fasteners 44, such as screws, extend through the holes 42 and into the aligned channels 34 for rigidly securing the cable receiver 38 to the shell 12.

With reference to FIG. 2, the plurality of cables 51 for being operatively connected to the depth finder 60, are readily attached and detached simultaneously. The projecting sleeves 48 of the cable connector 10 align with the port 62 in the back of the depth finder 60. The cable connector 10 is pushed to the port 62 to make electrical contact between the pins and sockets in the respective cable ends 50 with the port 62.

The present invention accordingly has provided a cable housing 10 particularly suited for convenient and simultaneously engaging and disengaging of a plurality of cables communicating with an operating device, such as the depth finder 60. However, it is noted that the cable housing 10 may be gainfully used with other operating devices that have a plurality of cables received in ports in the operating device for communicating power and electrical signals for processing and use by the device, such as computers and other multi-cable devices.

While this invention has been described in detail with particular reference to the preferred embodiments thereof, the principles and modes of operation of the present invention have been described in the foregoing application. While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. A cable bundle connector for simultaneously attaching or detaching a plurality of cables for an electronic apparatus, each cable having a cable connector and wires extending therefrom to a respective operational device for the electronic apparatus, comprising:

a housing body have two pairs of opposing sides that define an interior cavity with an open front end of the housing body and an opposing partially closed back end, with one side of the housing body defining a slot from the open front end to the partially closed back end for receiving a plurality of cables each having a cable connector at a first distal end of elongate wires in the cable and an operational device at a second distal end thereof, the cable connector and the operational device for at least one of the cables being too large to fit through the partially closed end of the housing body;

a cable receiver defining a plurality of sleeves, each configured to receive a cable connector of one of the plurality of cables; and fasteners for securing the cable receiver to the open front end of the housing, whereby the housing body, receiving the wires of the cables through the slot, enables the cable connectors to be received in the respective sleeves with the wires passing outwardly of the housing body through the partially closed back end so that the cable connectors are readily connected or disconnected simultaneously to the electronic apparatus.

2. The cable bundle connector as recited in claim 1, wherein a cross-sectional shape of each sleeve differs from the cross-sectional shape of the other sleeves.

3. The cable bundle connector as recited in claim 1, wherein one pair of opposing side walls define parallel projections from opposing inner surfaces, which projections define a stop for bearing against the cable receiver.

4. The cable bundle connector as recited in claim 3, wherein the projections terminate recessed relative to a front edge of the housing, whereby the cable receiver is recessed within the housing relative to a front edge.

5. The cable bundle connector as recited in claim 3, wherein the projections each define a longitudinally extending hole for receiving a fastener for securing the cable receiver to the housing body.

6. A connector for an electronic apparatus, which connector bundles together a plurality of cable ends attached to wires that connect at opposing distal ends to remote operational equipment for the electronic apparatus, comprising:

a shell having two pairs of opposing sides that define an open end and an opposing partially closed back that defines an opening, one of the sides defining a slot extending from the open end to the opening in the back;

a plurality of cables, each having a cable connector at a first distal end of an elongate wire bundle and an operational device at an opposing distal end thereof, the cable ends and the operational device of at least one of the cables being too large to fit through the opening in the back of the shell;

a cable receiver defining a plurality of sleeves to receive a respective cable connector of one of the plurality of cables; and fasteners for securing the cable receiver to the open end of the shell, whereby the shell, receiving portions of the wire bundles through the slot, enables the cable connectors to be received in the respective sleeves with the wire bundles passing outwardly of the shell through the partially closed back, so that the cable connectors are readily connected or disconnected simultaneously to the electronic apparatus.

7. The connector as recited in claim 6, wherein a cross-sectional shape of each sleeve corresponds to a cross-sectional shape of one of the cable connectors.

8. The connector as recited in claim 6, wherein one pair of the opposing sides define projections from opposing inner surfaces to define stops for bearing against the cable receiver.

9. The connector as recited in claim 8, wherein the projections terminate recessed relative to a front edge of the shell, whereby the cable receiver is recessed within the shell relative to the front edge.

10. The connector as recited in claim 8, wherein the projections each define an opening for receiving a fastener to connect the cable receiver to the shell.

11. A connector that bundles together a plurality of cable ends attached to wires that connect at opposing distal ends to remote operational equipment for a marine depth finder, comprising:

a shell having two pairs of opposing sides that define an open end and an opposing partially closed back that defines an opening, one of the sides defining a slot extending from the open end to the opening in the back;

a plurality of cables, each having a cable connector at a first distal end of an elongate wire bundle and an operational device for the marine depth finder at an opposing distal end thereof, the cable ends and the operational device for at least one of the cables being too large to fit through the opening in the back of the shell;

a cable receiver defining a plurality of sleeves to receive a respective cable connector of one of the plurality of cables; and fasteners for securing the cable receiver to the open end of the shell, whereby the shell, receiving portions of the wire bundles through the slot, enables the cable connectors to be received in the respective sleeves with the wire bundles passing outwardly of the shell through the partially closed back, so that the cable connectors are readily connected or disconnected simultaneously to the marine depth finder.

12. The connector as recited in claim 11, wherein a cross-sectional shape of each sleeve corresponds to a cross-sectional shape of one of the cable connectors.

13. The connector as recited in claim 11, wherein one pair of the opposing sides define projections from opposing inner surfaces to define stops for bearing against the cable receiver.

14. The connector as recited in claim 13, wherein the projections terminate recessed relative to a front edge of the shell, whereby the cable receiver is recessed within the shell relative to the front edge.

15. The connector as recited in claim 13, wherein the projections each define an opening for receiving a fastener to connect the cable receiver to the shell.

* * * * *